US006354812B1

(12) United States Patent
Todd

(10) Patent No.: US 6,354,812 B1
(45) Date of Patent: Mar. 12, 2002

(54) ADJUSTMENT MAXIMUM DISPLACEMENT STOP FOR VARIABLE DISPLACEMENT PISTON PUMP

(75) Inventor: Steven Todd, Kearney, NE (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/606,277

(22) Filed: Jun. 29, 2000

(51) Int. Cl.[7] ..... F01B 3/00
(52) U.S. Cl. ..... 417/269; 92/12.2; 91/505
(58) Field of Search ..... 417/222.1, 269; 92/71, 122; 91/505

(56) References Cited

U.S. PATENT DOCUMENTS 4,723,892 A * 2/1988 Cowan ..... 417/222.1
5,251,537 A * 10/1993 Hoshino et al. ..... 91/506
5,782,160 A 7/1998 Boone ..... 92/12.2

* cited by examiner

*Primary Examiner*—Charles G. Freay
(74) *Attorney, Agent, or Firm*—L. J. Kasper

(57) ABSTRACT

An adjustable stop assembly (33) for limiting maximum yoke angle of a hydraulic pump(11) having a fluid displacement proportional to the angle of the yoke (25). The adjustable stop assembly (33) includes a control piston (37) for inclining the yoke (25) to define a desired yoke angle, and a stop member (57) defines a set of internal threads (67) and is disposed within a cavity (65) defined by the adjustment assembly. An adjustment screw (51) is disposed for rotational motion, comprising a portion (49) operable to retain the adjustment screw (51) reciprocally stationary relative to the adjustment assembly (33), the adjustment screw (51) further comprising a first set of external threads (53) for engagement with the internal threads (67) of the stop member (57), whereby rotation of the adjustment screw (51) causes axial travel of the stop member (57), thereby displacing the control piston (37). The assembly has the cavity defining a generally cylindrical internal surface (65), and further defining a first axis (A1) about which the internal surface (65) is concentric. The set of internal threads (67) defined by the stop member (57) defines a second axis (A2), and the first (A1) and second (A2) axes are transversely offset.

6 Claims, 3 Drawing Sheets

ADJUSTMENT MAXIMUM DISPLACEMENT STOP FOR VARIABLE DISPLACEMENT PISTON PUMP

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to variable displacement hydraulic piston pumps, and more particularly, to such pumps which include an adjustable stop assembly for varying the fluid displacement of the pump. A piston pump of the type to which the present invention relates is illustrated and described in U.S. Pat. No. 5,782,160, now assigned to the assignee of the present invention, and incorporated herein by reference.

The variable displacement piston pump of the above-incorporated patent includes an adjustable maximum displacement stop assembly for limiting the maximum angle of the swashplate (yoke) to something less than the maximum angle possible for the particular pump design. As is well know to those skilled in the art, for a given input speed to the pump, the rate of fluid flow provided by the pump is proportional to the angle of displacement of the swashplate. Therefore, many piston pumps, especially those intended for industrial uses (as opposed to mobile applications) are designed for a maximum displacement (maximum flow) and then are "set" or adjusted for a particular use by having the swashplate positioned at a particular angle, less than the maximum, which angle (effectively, a new "maximum" displacement) will provide the desired flow rate. Once the desired swashplate displacement is set, the adjustable stop assembly is prevented from further movement by some suitable locking means.

In the adjustable stop assembly of the above-incorporated patent, there is a control piston which is linked to the yoke, the control piston defining an internal, hexagonal cavity in which is disposed a hexagonal stop member. The stop member is in threaded engagement with an adjusting screw, such that rotation of the adjusting screw results in linear movement of the hexagonal stop, and therefore, linear movement of the control piston also. It is the linear movement of the control piston which directly changes the displacement angle of the swashplate.

It should be noted that in the adjustable maximum displacement stop assembly of the cited patent, the control piston, the hexagonal stop, and the adjusting screw are all coaxial with each other.

The prior art adjustable stop assembly has been generally satisfactory in performance, i.e., in achieving and maintaining the desired displacement angle of the swashplate. However, the inherent requirement for certain parts of the assembly to be non-circular (preferably, hexagonal) adds substantially to the cost and difficulty of manufacture of at least two components of the assembly, in this case, the control piston and the stop. In addition, the prior art assembly required a mechanical connection between the swashplate and the control piston, partly for the purpose of preventing rotation of the control piston. In the prior art assembly, if the control piston were permitted to rotate, there would be no linear movement of the control piston. Typically, the mechanical connection between the swashplate and the control piston is a member referred to as a "chain link", which is not an especially difficult or complicated part, but on some applications of the pump, does represent one additional part which serves no purpose, other than to prevent rotation of the control piston.

BRIEF SUMMARY OF THE INVENTION

Accordingly, it is an object of the present invention to provide an improved variable displacement hydraulic piston pump, and an improved adjustable maximum displacement stop assembly therefor which overcomes the above-described disadvantages of the prior art.

It is a more specific object of the present invention to provide such an improved adjustable stop assembly which eliminates the need for expensive and difficult-to-manufacture non-circular parts.

It is another object of the present invention to provide such an improved adjustable stop assembly in which is not necessary to provide means for preventing rotation of the control piston.

The above and other objects of the invention are accomplished by the provision of an improved adjustable stop assembly for limiting maximum yoke angle of a hydraulic pump having a fluid displacement proportional to the angle of the yoke, the adjustable stop assembly including a control piston for inclining the yoke to define a desired yoke angle. A stop member defines a set of internal threads and is disposed within a cavity defined by the adjustable stop assembly. The assembly also includes an adjusting screw disposed for rotational motion, comprising means operable to retain the adjusting screw reciprocally stationary relative to the adjustable stop assembly. The adjusting screw further comprises a first set of external threads for engagement with the internal threads of the stop member whereby rotation of the adjusting screw causes axial travel of the stop member thereby displacing the control piston.

The improved adjustable stop assembly is characterized by the cavity defining a generally cylindrical internal surface, and further defining a first axis about which the internal surface is concentric. The set of internal threads defined by the stop member defines a second axis, the first and second axes being transversely offset.

DETAILED DESCRIPTION OF THE PREFERRED EMBODIMENT

Figure 1:
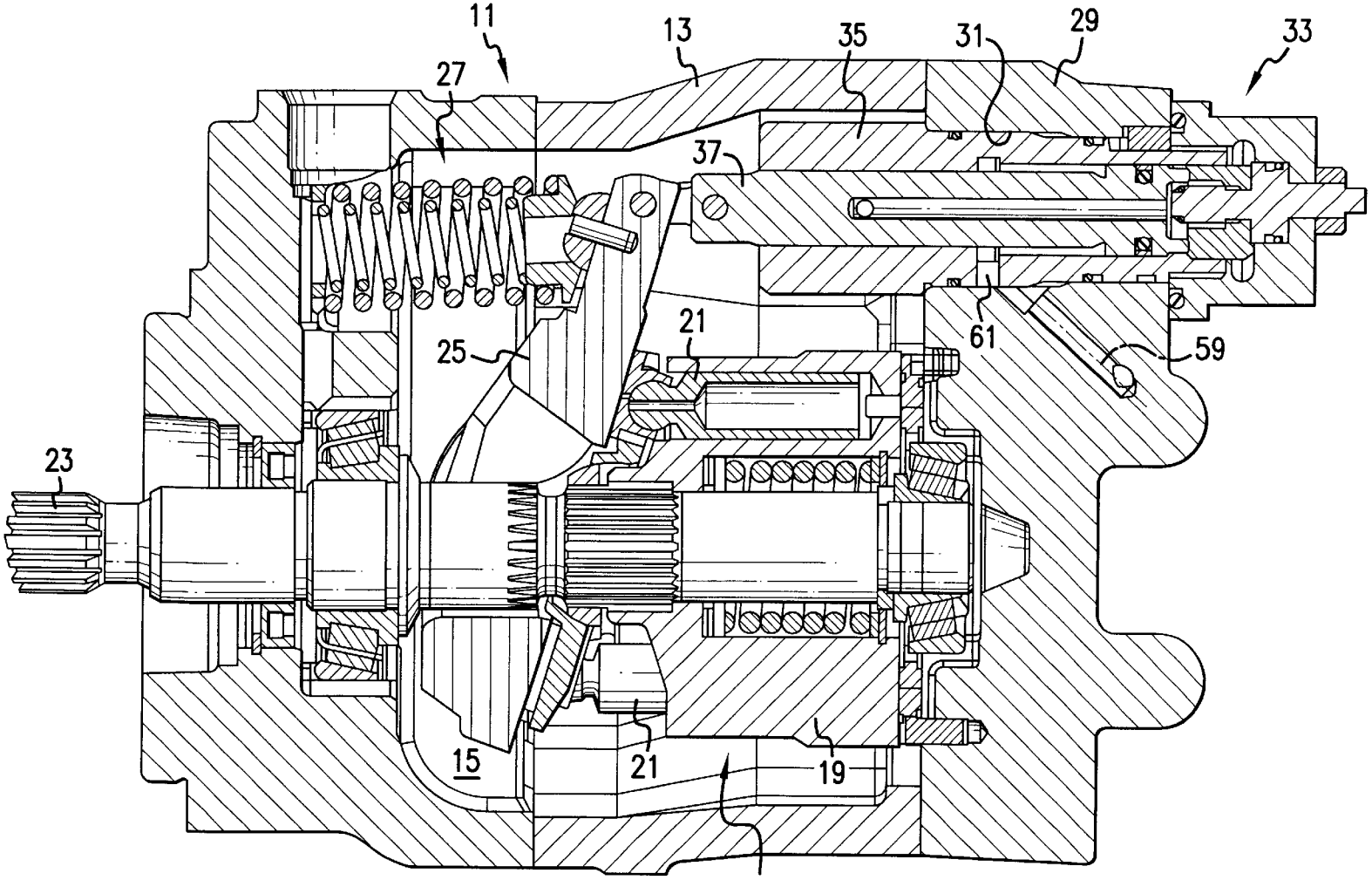
FIG. 1 is an axial cross-section of a variable displacement hydraulic piston pump including the improved adjustable stop assembly of the present invention.

Referring now to the drawings, which are not intended to limit the invention, FIG. 1 illustrates a variable displacement hydraulic piston pump, generally designated 11, the pump 11 also being frequently referred to as an axial piston pump for reasons which are well know to those skilled in the hydraulic pump art.

The pump 11 includes a housing 13 defining therein a pumping chamber 15, and disposed within the chamber 15 is a rotating group, generally designated 17. The rotating group 17 includes, by way of example only, a rotating cylinder barrel 19, and a plurality of axially oriented pistons 21, only one being shown fully, and in cross-section in FIG. 1.

During operation of the pump 11, a rotational input torque is transmitted to the cylinder barrel 19 by means of an input shaft 23, which is rotatably supported relative to the housing 13, and extends axially through a central opening in a yoke 25 (also referred to as a "swashplate"). As is well know to those skilled in the art, the pistons 21 engage a surface of the yoke 25 as the cylinder barrel 19 rotates. The angle of inclination of the yoke 25 determines the length of axial stroke of each piston 21 as the rotating group 17 rotates, the cross-sectional area of the pistons 21 and the length of the axial stroke thereof defining the displacement of the pump (in terms of units of volume per revolution).

Disposed adjacent the yoke 25 is a spring pack 27, the function of which is to bias the yoke 25 toward its maximum angle of inclination, in the absence of a hydraulic load being imposed on the yoke 25 by virtue of the pistons 21 being subjected to a substantial discharge pressure.

Disposed at the rearward end of the housing 13 (right end in FIG. 1) is an end cap 29, and typically, although not essential to the present invention, it is the end cap 29 which would define the inlet port and the outlet port (neither of which is shown herein).

Referring still primarily to FIG. 1, the end cap 29 defines a cylindrical bore 31, and disposed therein, and extending to the right of the end cap 29 is an adjustable maximum displacement stop assembly, generally designated 33. It should be apparent to those skilled in the art that the stop assembly 33 could, within the scope of the invention, be disposed within the housing 13, rather than within the end cap 29. The maximum displacement stop assembly 33 includes a cylindrical sleeve 35 which is preferably retained in a fixed position relative to the end cap 29, by a means to be described subsequently. It should be understood that the sleeve 35 is not an essential feature of the invention, and subsequently herein, both the sleeve 35 and the end cap 29 may be referred to, individually or together, by the generic term "housing". Slidably disposed within the sleeve 35 is a control piston 37, shown in FIG. 1 in its rightward most position, corresponding to the maximum possible angle of inclination of the yoke 25.

Figure 2:
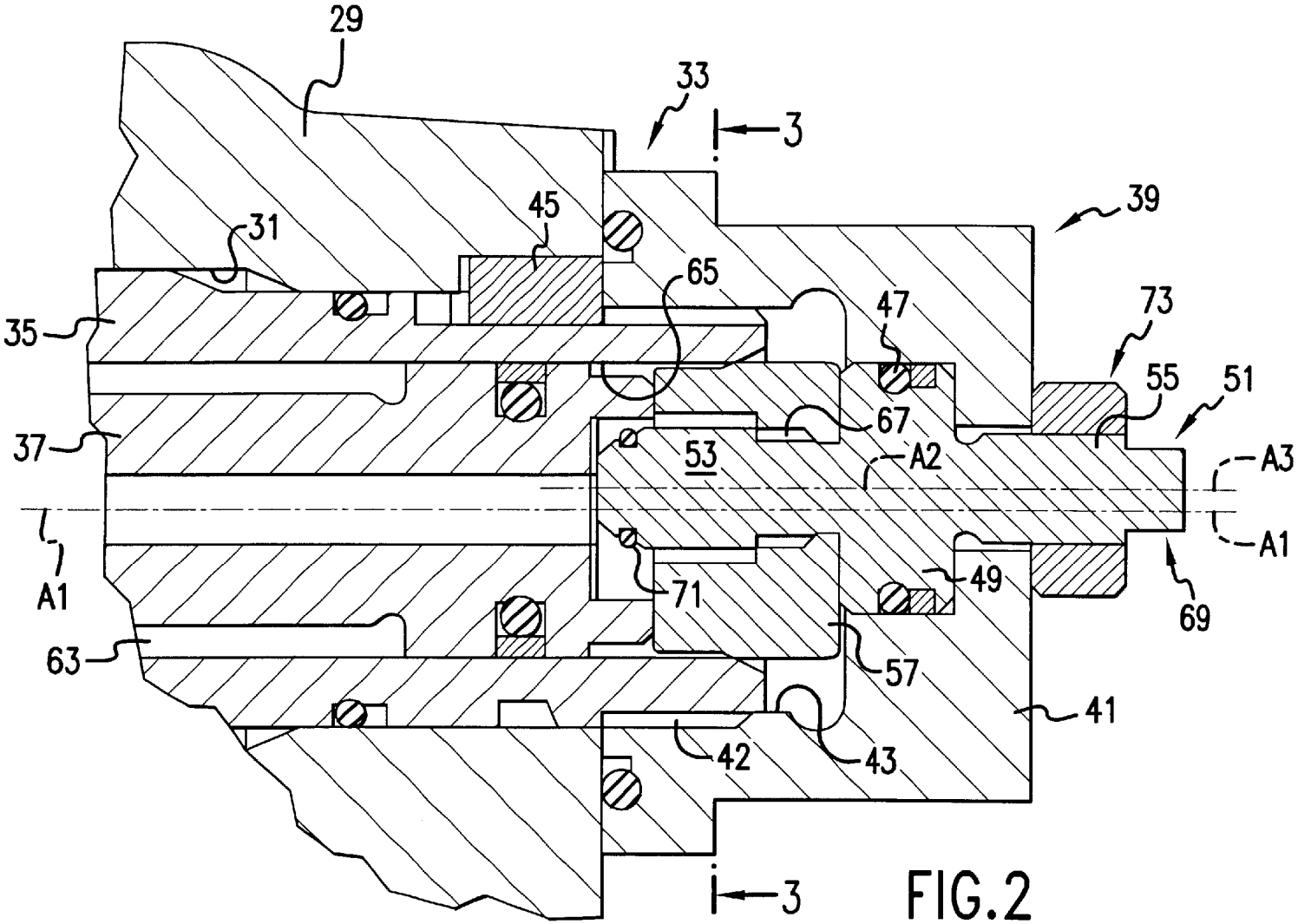
FIG. 2 is a greatly enlarged, fragmentary, axial cross-section similar to FIG. 1, illustrating the adjustable stop assembly of the present invention in greater detail.

Referring now to FIG. 2, in conjunction with FIG. 1, it may be seen that the adjustable stop assembly 33 also includes an adjustment portion, generally designated 39. The adjustment portion 39 includes an adjustment housing 41 attached to the end cap 29 by any suitable means (not shown herein). In the subject embodiment, and by way of example only, the right end of the sleeve 35 is provided with a set of external threads 42 which extend into an annular, internally threaded chamber 43 defined by the housing 41. Thus, the engagement of the external threads 42 and the internal threads defined by the adjustment housing 41 serve to retain the sleeve 35 and the housing 41 in the fixed axial position shown in FIG. 2. As may best be seen in FIG. 2, rotation of the sleeve 35 relative to the end cap 29 is prevented by means of a key 45 in a manner well know to those skilled in the art.

The housing 41 also defines a somewhat reduced diameter chamber 47. Disposed within the chamber 47 is an enlarged portion 49 of an adjustment screw, generally designated 51, the enlarged portion 49 being rotatable within the chamber 47. The adjustment screw 51 includes an inner, externally-threaded portion 53, and an outer, externally-threaded portion 55. As is used herein, the term "inner" means merely that the portion 53 is disposed within the adjustment portion 39, whereas the term "outer" means merely that the portion 55 is disposed partially outside of the housing 41.

In threaded engagement with the externally-threaded portion 53 of the adjustment screw 51 is a generally cylindrical stop member 57, the left end of which (in FIG. 2) is in engagement with the right end of the control piston 37. Referring now to FIGS. 1 and 2 together, the end cap 29 defines an angled fluid passage 59, preferably in fluid communication with the pump outlet port (not shown herein), such that the passage 59 contains high pressure (outlet pressure) whenever the pump is operating against a load. The pressurized fluid in the passage 59 is communicated through a radial bore 61, defined by the sleeve 35, and into an annular pressure chamber 63. As may be understood by those skilled in the art, fluid pressure in the chamber 63 will tend to bias the control piston 37 to the right in FIGS. 1 and 2, into the engagement with the stop member 57 as described above. Those skilled in the art will understand that, although the stop assembly 33 sets the maximum permissible displacement of the pump, the pump would typically also include some sort of displacement control to vary instantaneous pump displacement between zero (neutral) and the pre-set maximum displacement. The pump displacement control would typically operate hydraulically, such as by pump output pressure or load signal pressure, as is well known to those skilled in the art.

Figure 3:
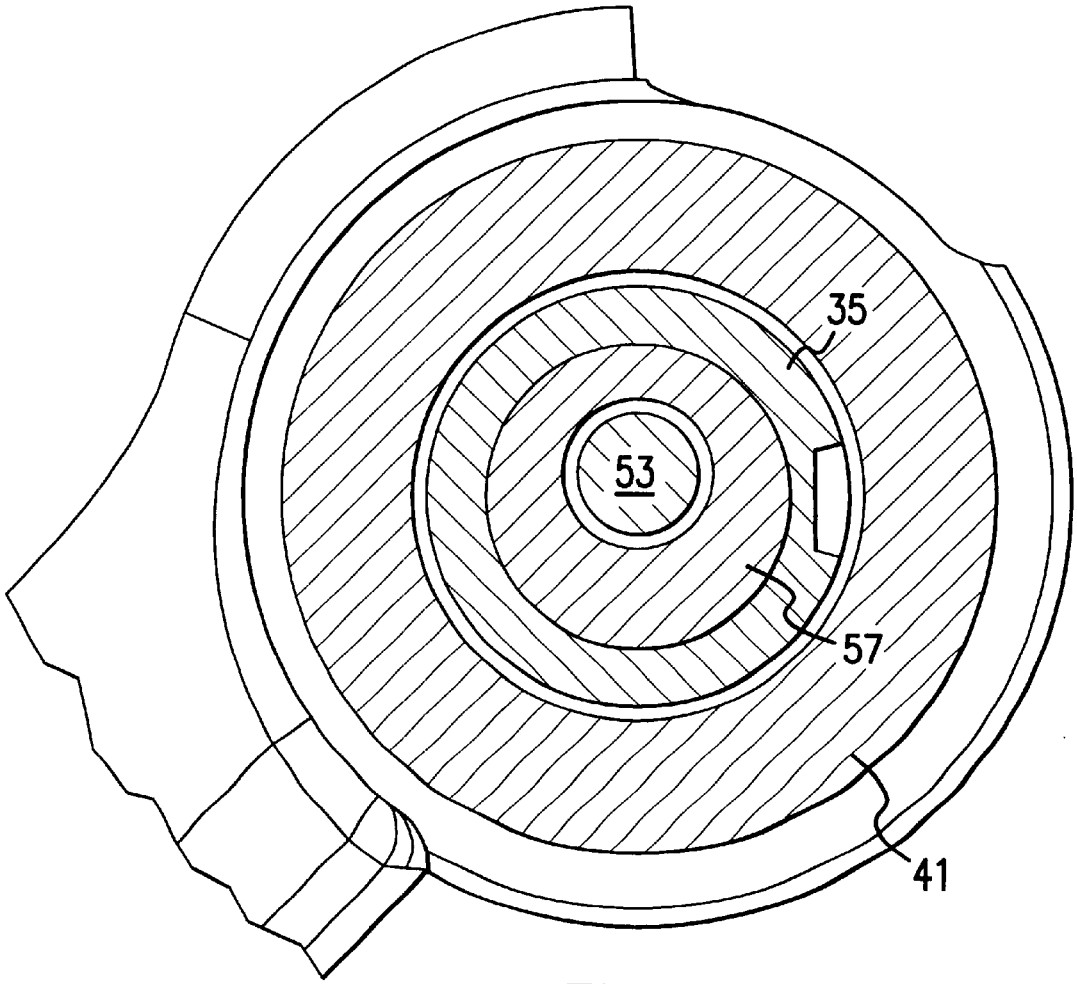
FIG. 3 is a transverse cross-section taken on line 3—3 of FIG. 2, and on approximately the same scale, illustrating one important aspect of the invention.

Referring again primarily to FIG. 2, the right end of the sleeve 35 defines a cylindrical, internal cavity 65, such that, during the process of adjusting the linear position of the control piston 37, the stop member 57 moves linearly within the cylindrical, internal cavity 65. The surface of the cavity, which will also bear the reference numeral 65, defines a first axis A1, and it may be seen in FIG. 2 that the axis of the control piston 37 coincides with the first axis A1. In accordance with an important aspect of the invention, the stop member 57 defines a set of internal threads 67 which are in threaded engagement with the externally-threaded portion 53 of the adjustment screw 51. A novel feature of the invention resides in the fact that the internal threads 67 define an axis A2, wherein the axis A2 is transversely offset from the axis A1. In other words, the internal threads 67 are eccentric relative to the outer, cylindrical surface of the stop member 57, as may best be seen in FIG. 3, but in accordance with one of the objects of the invention, none of the parts of the adjustable stop assembly 33 is non-circular. The adjustment screw 51 defines a third axis A3 which, in the embodiment shown, is coincident with the second axis A2.

At its far right end, the adjustment screw 51 includes a preferably square or hexagonal head 69, by means of which the adjustment screw 51 may be rotated by any suitable tool, such as an open-end or box-type wrench. When it is desired to adjust the displacement of the pump, to achieve a new maximum displacement setting, the appropriate tool is used to rotate the adjustment screw 51. As the screw 51 is rotating, the engagement of the threaded portion 53 and the internal threads 67 is resulting in linear movement (to the left in FIG. 2) of the stop member 57. Because of the transverse offset of the axes A1 and A2, the stop member 57 cannot rotate within the cavity 65, but can only move linearly, in response to the pure rotation of the screw 51. As the stop member 57 moves linearly within the cavity 65, to the left in FIG. 2, the control piston 37 is moved correspondingly to the left, to define a new "maximum" displacement stop position for the pump yoke 25.

Disposed about the left end of the threaded portion 53 is a snap ring 71, which effectively limits the relative axial movement of the threaded portion 53 and the stop member 57, thereby also effectively limiting the amount by which the new maximum displacement of the pump 11 can be reduced from the nominal displacement of the pump (i.e., in the position shown in FIG. 1).

Once the desired position of the control piston 37 has been achieved, thus setting the new maximum displacement of the pump 11, a lock nut 73 may be tightened about the externally-threaded portion 55, against the adjacent surface of the adjustment housing 41. With the lock nut 73 tightened, the new maximum displacement of the pump is "fixed" until the lock nut 73 is later loosened, and the displacement again adjusted.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. An adjustable stop assembly for limiting a maximum yoke angle of a hydraulic pump having a fluid displacement proportional to the angle of the yoke, said adjustable stop assembly including a control piston for inclining the yoke to define a desired yoke angle; a stop member defining a set of internal threads and being disposed within a cavity defined by said adjustment assembly, an adjustment screw disposed for rotational motion, comprising means operable to retain said adjustment screw reciprocally stationary relative to said adjustment assembly, said adjustment screw further comprising a first set of external threads for engagement with said internal threads of said stop member, whereby rotation of said adjustment screw causes axial travel of said stop member, thereby displacing said control piston, characterized by:

(a) said cavity defining a generally cylindrical internal surface, and further defining a first axis about which said internal surface is concentric; and (b) said set of internal threads defined by said stop member defining a second axis, and said first and second axes being transversely offset.

2. An adjustable stop assembly as claimed in claim 1, characterized by said adjustment screw defining a third axis, and said second and third axes being substantially coincident.

3. An adjustable stop assembly as claimed in claim 1, characterized by said control piston being reciprocably disposed in a housing, said housing defining said cavity, whereby said control piston and said stop member are in axial abutment with each other.

4. An adjustable stop assembly as claimed in claim 1, characterized by said means operable to retain said adjusting screw reciprocally comprises said adjusting screw including an enlarged diametral portion disposed within a mating, generally cylindrical chamber defined by an adjustment housing of said adjustable stop assembly.

5. An adjustable stop assembly as claimed in claim 1, characterized by said adjustment screw further comprising a second set of external threads, disposed external to an adjustment housing, said second set of external threads being in threaded engagement with an internally-threaded lock member.

6. An adjustable stop assembly as claimed in claim 1, characterized by said set of internal threads defined by said stop member and said first set of external threads defined by said adjustment screw cooperating to define means operable to prevent disengagement of said set of internal threads and said first set of external threads.

* * * * *